US005165191A

United States Patent [19]

Davis

[11] Patent Number: 5,165,191

[45] Date of Patent: Nov. 24, 1992

[54] FRONT END LOADER ATTACHMENT CONVERTIBLE BETWEEN LOADING BUCKET AND SIDE-SHIFT-ANGLE DOZER CONFIGURATIONS

[75] Inventor: Charles J. Davis, Green Valley, Ariz.

[73] Assignee: William G. Davis, Wichita, Kans.

[21] Appl. No.: 841,586

[22] Filed: Feb. 25, 1992

[51] Int. Cl.[5] ..... E02F 3/96

[52] U.S. Cl. ..... 37/117.5; 37/118 A; 37/DIG. 12; 414/912; 172/818

[58] Field of Search ..... 37/117.5, 118 A, DIG. 12, 37/DIG. 15; 172/815, 817, 818; 414/724, 912

[56] References Cited

U.S. PATENT DOCUMENTS

| | | | |
|---|---|---|---|
| 2,768,760 | 10/1956 | Pilch | 37/DIG. 5 |
| 2,812,595 | 11/1957 | Drott | 37/117.5 |
| 2,824,391 | 2/1958 | Roemer | 37/117.5 |
| 2,967,364 | 1/1961 | Wasner et al. | 172/818 |
| 3,071,793 | 1/1963 | Lull | 15/82 |
| 3,077,999 | 2/1963 | Svoboda | 37/118 A |
| 3,243,067 | 3/1966 | Artman | 37/117.5 X |
| 3,344,454 | 10/1967 | Ulrich | 37/117.5 |
| 3,375,595 | 4/1968 | Beltrami | 37/117.5 |
| 3,539,022 | 11/1970 | Berg | 172/805 |
| 3,559,314 | 2/1971 | Funk | 37/117.5 |
| 3,591,935 | 7/1971 | Bremmer | 37/117.5 |
| 3,759,110 | 9/1973 | Davis | 74/99 R |
| 4,566,844 | 1/1986 | Camph | 37/117.5 X |
| 4,633,601 | 1/1987 | Fleck et al. | 37/118 R |
| 4,854,811 | 8/1989 | Veys | 37/DIG. 12 |
| 4,890,400 | 1/1990 | Long | 37/117.5 |
| 4,974,350 | 12/1990 | Puckett | 37/117.5 |

*Primary Examiner*—Randolph A. Reese
*Assistant Examiner*—Arlen L. Olsen
*Attorney, Agent, or Firm*—Hovey, Williams, Timmons & Collins

[57] ABSTRACT

A quick-convert bucket attachment for front end loaders has hydraulically positioned, interlocking bucket components that may be manipulated by controls at the tractor seat or other convenient location for rapid conversion of the attachment from a general purpose loading bucket to a side-shift angle dozer. The back wall of the bucket is formed by the dozer blade, while the side walls and floor of the bucket are formed by a clam which may be raised into an elevated position to expose the dozer, at which time the dozer may be either maintained in a centered, straight-forward position or shifted laterally into a left or right, obliquely angled position. The dozer blade is completely immobilized and is held solidly against a main base of the attachment when the clam is in its lowered position, thus presenting a rugged bucket capable of functioning in all respects as a conventional loader bucket at that time.

22 Claims, 4 Drawing Sheets

FRONT END LOADER ATTACHMENT CONVERTIBLE BETWEEN LOADING BUCKET AND SIDE-SHIFT-ANGLE DOZER CONFIGURATIONS

TECHNICAL FIELD

This invention relates to front end loader attachments and, more particularly, to an attachment which is quickly and easily converted between a standard loading bucket configuration and a side-shift angle dozer configuration without the operator leaving the tractor seat.

BACKGROUND OF THE INVENTION

Having a loader equipped with a loading bucket permits the operator to scoop up loose materials, carry them a short distance and then dump them onto the ground or into a receptacle. Such buckets are very versatile and are used in a wide variety of earth moving and material handling jobs with great success.

However, there are some jobs for which the bucket is simply not well-suited. For example, when back-filling a ditch, using the essentially single purpose bucket to perform that task is tedious and inefficient, and frequently produces poor quality results. In order to return the long windrow or "spoil" of dirt to the ditch from a position alongside the ditch, the operator must repeatedly maneuver the tractor back and forth at an angle to the ditch, pushing and shoving the spoil pile into the open ditch while at the same time twisting and turning the vehicle which tears up the soil and grass in the vicinity. Much time is consumed in the process and the end result is not a particularly neat or professional-looking job.

Instead of the bucket, it would be better for the operator to use an angled dozer blade which has also been shifted laterally from a centered position so that the operator only needs to drive along the ditch in a parallel path of travel while engaging the line of spoil with the angled dozer blade and thus continually diverting the spoil directly into the ditch as the tractor moves along. However, while such side-shift-angle dozer attachments are currently commercially available, they are intended for use only after the bucket has first been removed from the loader arms, leaving a place for the side-shift dozer blade to be attached in their absence. While such interchanging of the standard buckets and side-shift-angle dozer attachments is theoretically quite possible, as a practical matter the standard bucket is seldom replaced with the dozer attachment because it is a cumbersome, time consuming and difficult task to do so. For one thing, the massive weight of the attachments themselves makes such interchanging job a considerable effort for one man to accomplish. Furthermore, the side-shift-angle dozer is usually only required for a relatively short period of time, whereupon it becomes necessary to reverse the procedure and detach the dozer blade and hook up the bucket. As a consequence, operators simply tend to make do with the bucket alone and leave the side-shift dozer blade back at the shop, even though use of the bucket for dozing, backfilling, and clean-up work has a number of disadvantages, as discussed above.

SUMMARY OF THE PRESENT INVENTION

Accordingly, one important object of the present invention is to provide a loader attachment which, without requiring detachment from the loader arms, is quickly and easily convertible from a standard bucket configuration to a side-shift-angle dozer configuration without requiring the operator to leave the tractor seat. In other words, instead of requiring that the operator take off the standard bucket and replace it with a side-shift-angle dozer, the present invention contemplates that the operator may simply operate the appropriate controls at the tractor seat to literally transform the bucket into a side-shift-angle dozer, and back again, by moving certain components of the attachment into and out of different operating positions and relationships with one another.

In carrying out the foregoing object, the present invention contemplates having a bucket in which the back wall doubles as the dozer blade and the sides and bottom wall are connected together to form what may be termed a "clam" that can be swung up out of the way to expose the dozer blade. Once the clam is raised, the dozer blade can be shifted laterally and cocked into an obliquely angled orientation to perform its dozing functions. The bucket configuration is quickly reestablished by simply returning the dozer blade to its centered, squared up position and then lowering the clam back down into close proximity to the dozer blade so that it once again becomes the back wall of the reestablished bucket. If desired, once the clam is raised, the dozer blade may be maintained in its straight forward position to simply shove the materials forwardly, and the clam may be used in cooperation with the straight ahead blade to clamp logs or other objects against the dozer blade so that the loader can be utilized to pick up, grip and carry such objects from one position to another.

In its preferred form, the convertible attachment of the present invention has a sturdy, rugged base that is connected directly to the lift arms of the loader and serves as the foundational member upon which all other components of the attachment are mounted. Thus, instead of the clam being mounted on and carried by the dozer blade, it is attached directly to the base component and stays behind in a straight forward, although raised, position when the dozer blade is shifted into either of its left or right, side-shifted, obliquely angled positions. When the dozer blade is back in its original squared-up position, and the clam is lowered to present a bucket configuration, the clam effectively clamps the dozer blade against the base member and provides a very rugged, general purpose bucket that will withstand the rigors of heavy use in spite of being formed from a plurality of separate components that are readily separable to transform the bucket into a different configuration.

While the prior art has included a variety of attachments which could be converted between standard bucket and clam configurations, and while side-shift-angle dozers have heretofore been available, to my knowledge no one has previously provided a convertible bucket which may be quickly and easily transformed into a side-shift-angle dozer, and vice-versa. As an example of a bucket having a clam which can be raised to expose a dozer blade, see the Drott U.S. Pat. No. 2,812,595. For a disclosure of a side-shift-angle dozer attachment, see, for example, my own prior U.S. Pat. No. 3,759,110. U.S. Pat. No. 4,890,400 to Long shows a bucket which can be manually swiveled into an obliquely angled position and the side and bottom walls of the bucket raised in the nature of a clam to expose the back wall as a dozer blade.

DESCRIPTION OF THE PREFERRED EMBODIMENT

Figure 1:
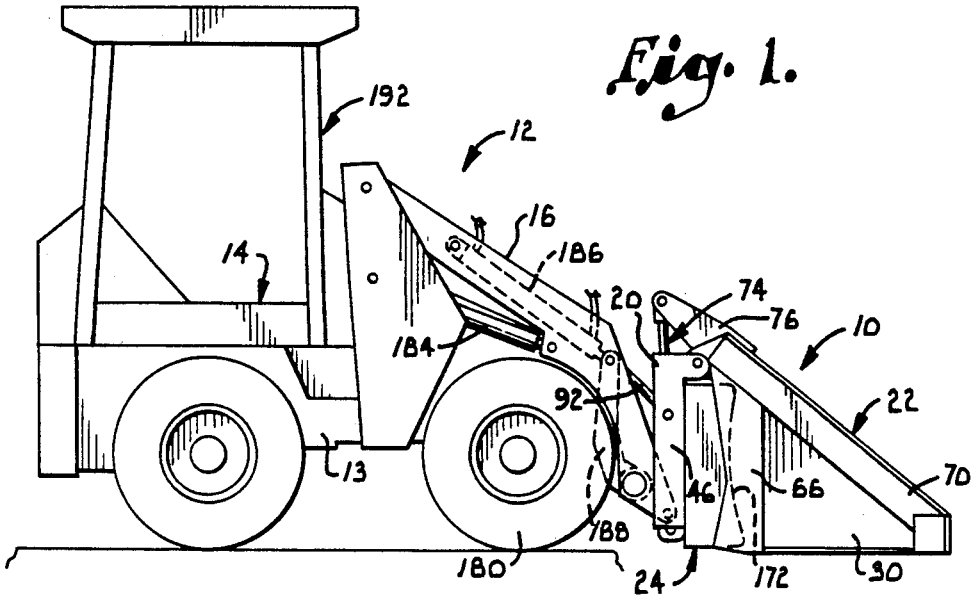
FIG. 1 is a right side elevational view of a front end loader equipped with a convertible bucket attachment in accordance with the present invention, the attachment being illustrated in its bucket configuration.
Figure 2:
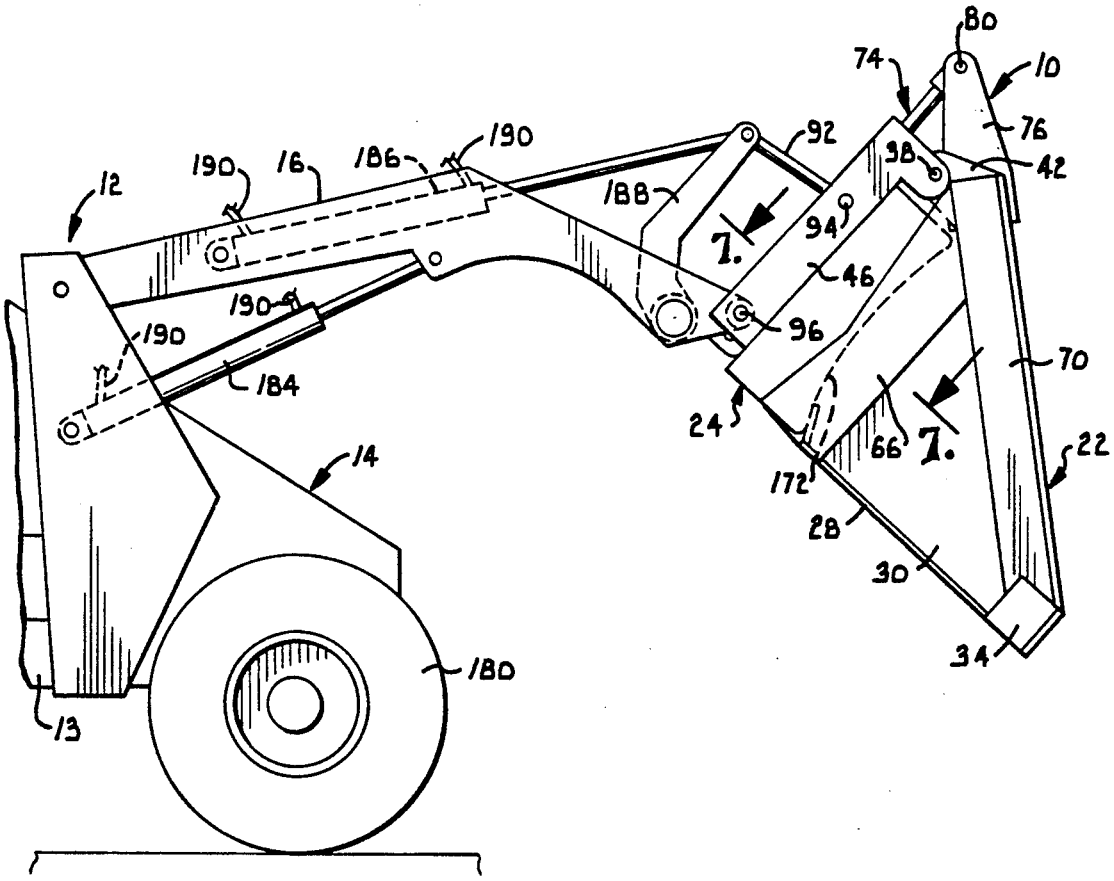
FIG. 2 is an enlarged fragmentary right side elevational view showing the convertible bucket attachment elevated and swung forwardly into a dump position.

Referring initially to FIGS. 1 and 2, a convertible bucket attachment 10 in accordance with the present invention is mounted to a front end loader 12 to be lifted and swung about a horizontal axis between loading and dumping positions as shown by a comparison of FIGS. 1 and 2. The front end loader 12 is mounted on the chassis 13 of a tractor 14 and includes a pair of forwardly extending, laterally spaced apart lift arms 16 and 18 (a portion of the latter being visible in FIG. 8).

Figure 4:
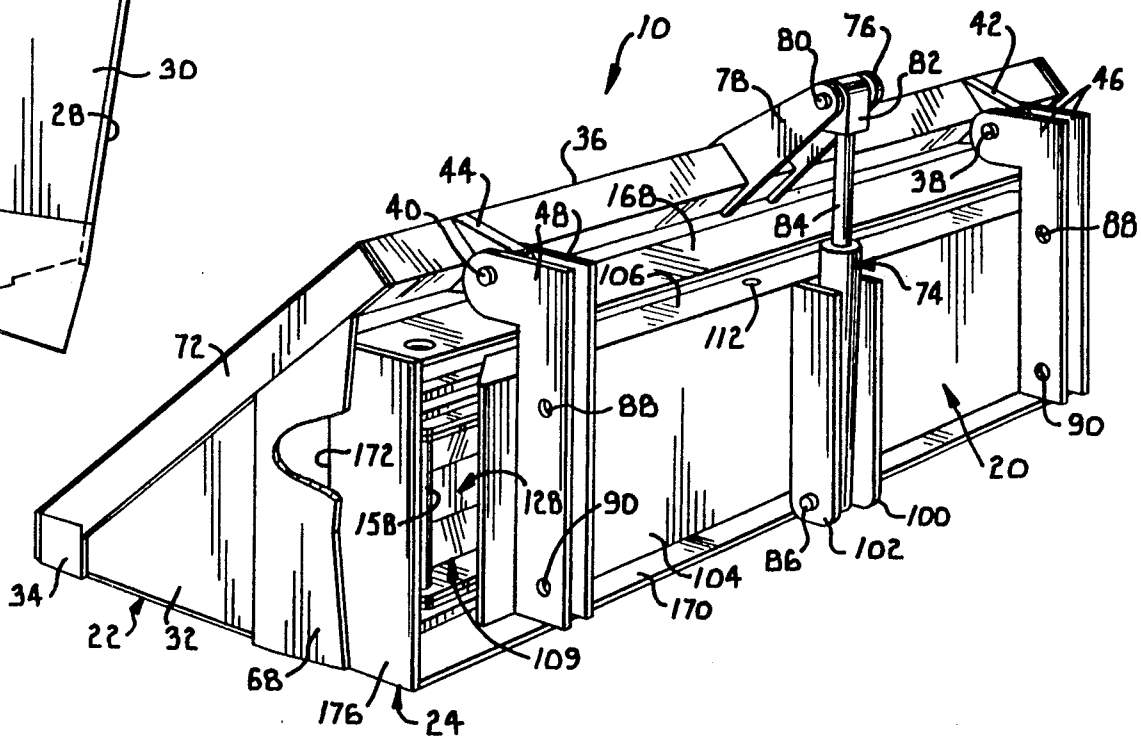
FIG. 4 is an enlarged, left rear perspective view of the attachment in its bucket configuration showing the way in which the main operating components of the attachment are all mounted on the transverse foundational base of the attachment.
Figure 8:
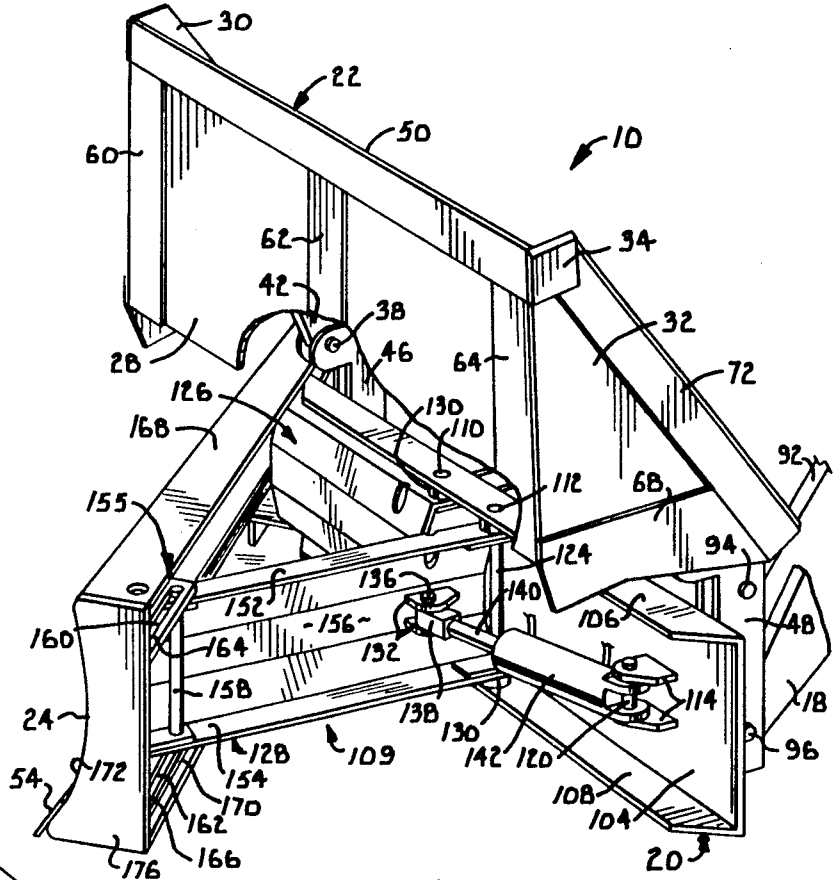
FIG. 8 is a fragmentary left front perspective view of the attachment in the right, side-shift angle dozer configuration of FIG. 5.

In greater detail, and as perhaps shown best in FIGS. 4 and 8, the convertible bucket attachment 10 broadly includes three major components, i.e., a main transverse structural base 20 attached to the front ends of the loader arms 16,18, a clam 22 swingably attached to and carried by the base 20, and an angularly shiftable dozer blade 24 likewise mounted on the base 20, but independently of the clam 22. As shown in FIG. 8, the clam 22 includes a generally rectangular floor 28, a pair of triangular, spaced-apart, upright, substantially parallel side walls 30 and 32 joined along their lower edges to opposite lateral extremities of the floor 28, and a transverse structural beam 36 (FIG. 4) interconnecting the side walls 30,32 across their upper rear ends. The tubular beam 36 forms the main torsional backbone of the clam 22. The side walls 30 and 32 lie in substantially vertical, parallel planes, while the beam 36 is parallel to the transverse axis about which the clam 22 swings relative to the base 20. The aforesaid swing axis is defined by aligned hinge pins 38 and 40 (FIG. 4) which respectively connect rearwardly extending lugs 42 and 44 on the beam 36 to the upper ends of a pair of upright mounting brackets 46 and 48 fixed to the back side of the base 20. In this manner the clam 22 is swingably supported by and coupled with the base 20.

Figure 3:
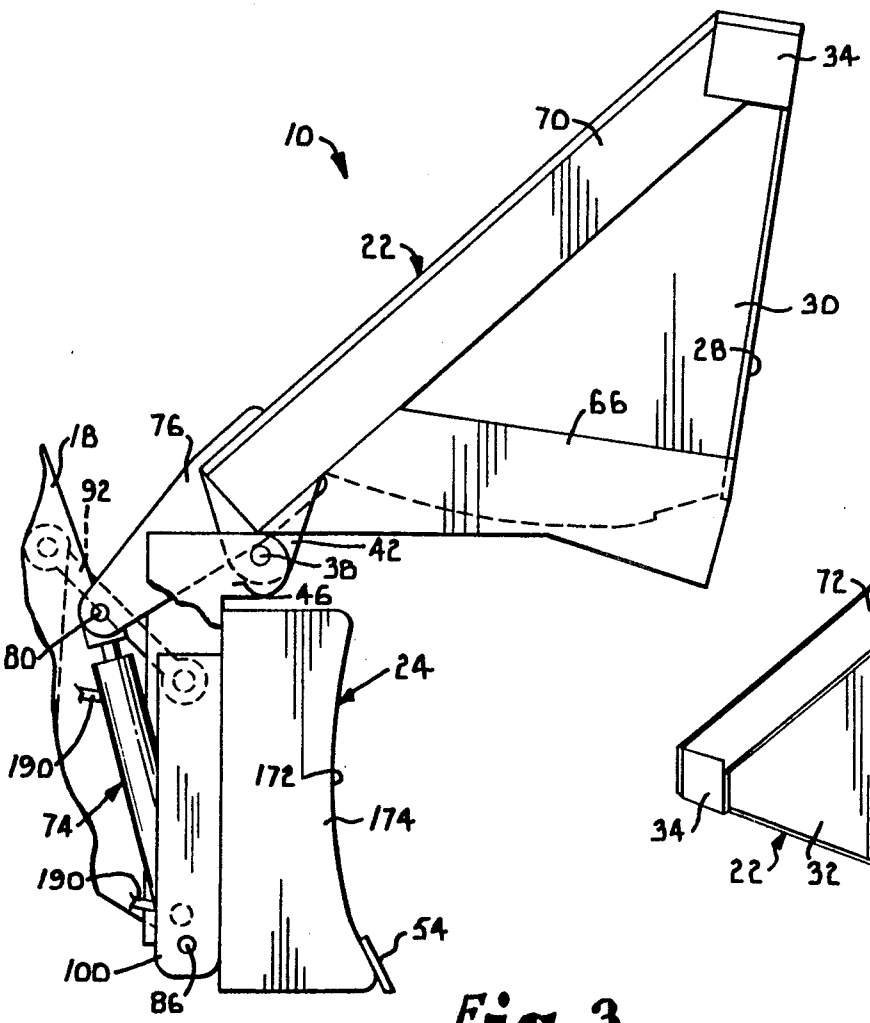
FIG. 3 is an enlarged, fragmentary side elevational view of the attachment showing the clam portion in a raised position to reveal the dozer blade.
Figure 7:
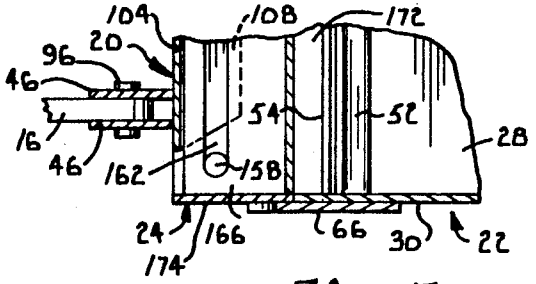
FIG. 7 is a fragmentary horizontal cross-sectional view taken along line 7—7 of FIG. 2 of the right, rear corner of the attachment showing part of the lost-motion connection between the swing arm and the dozer blade at that location.
Figure 6:
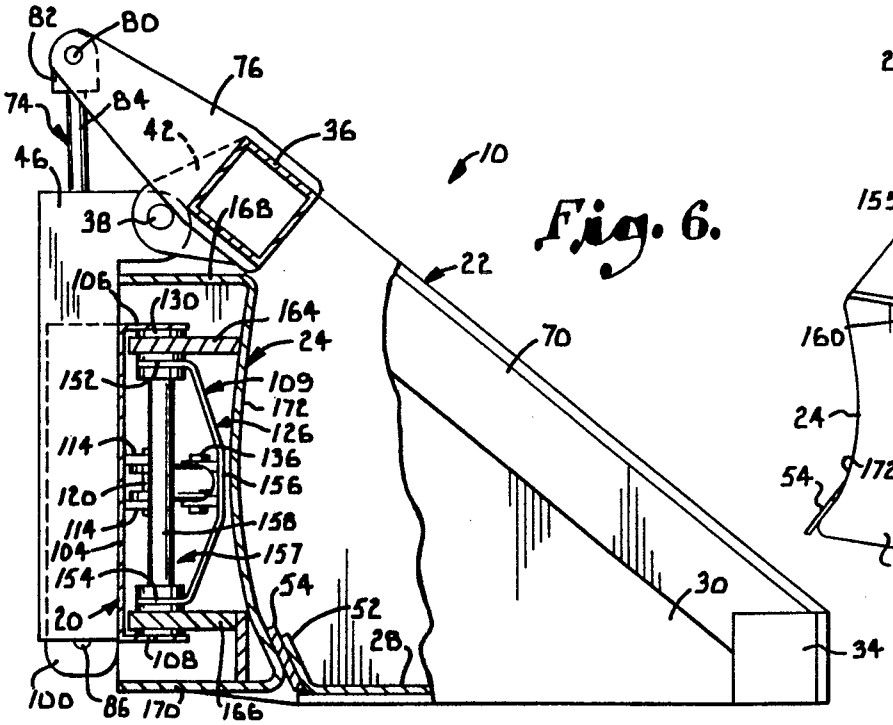
FIG. 6 is an enlarged right side elevational view of the attachment in the bucket configuration and in partial section showing the dozer blade positioned as the back wall of the bucket.

The floor 28 of the clam 22 is substantially planar and is provided with a front transverse scraping edge 50 extending between side walls 30 and 32. As illustrated in FIGS. 6 and 7, the floor 28 along its rear margin is upturned to present an upwardly and rearwardly projecting, transversely extending abutment flange 52 which is configured to engage and bear against a lower front scraping knife 54 on the dozer blade 24 when the clam 22 is in its lowered position as in FIG. 6. As shown in FIG. 8, three fore-and-aft skid plates 60, 62 and 64 are affixed to the bottom of floor 28 to strengthen the latter. As shown in FIGS. 3, 4 and 8, a pair of right and left, upright stiffening plates 66 and 68 are fixed to side walls 30,32 at their rear extremities, and fore-and-aft, downwardly inclined side cutter members 70,72 lead from the upper ends of the plates 66,68 to the lower front corners of the side walls 30,32. Gussets 34 provide additional strengthening between the side cutters 70,72 and floor 28.

The clam 22 is raised and lowered about pivot pins 38,40 by an upright double acting hydraulic cylinder 74 on the rear of the base 20 (FIGS. 3 and 4). A pair of side-by-side crank arms 76 and 78 extend normally rearwardly from beam 36 and have a pivot pin connection 80 with the head 82 of the extensible shaft 84 of the cylinder 74. The lower, anchor end of cylinder 74 is pivotally mounted to base 20 by pin 86.

The mounting base 20 is transversely generally U-shaped (FIGS. 4 and 8) in the nature of a wide structural channel member, presenting an upright flat bight 104 and a pair of upper and lower, longitudinal flanges 106,108 which project forwardly from bight 104. The clam mounting brackets 46,48 are fixed to the rear face of bight 104 and project upwardly beyond the upper flange 106 to provide operating clearance for the dozer blade 24 as will hereinafter be described in more detail. Upper holes 88 and lower holes 90 in the brackets 46,48 provide points of attachment of the base 20 to the loader 12. As shown in FIG. 2, for example, dump links 92 of the loader 12 are connected by pins 94 to holes 88, while lift arms 16,18 are connected by pins 96 to lower holes 90. A pair of upright, laterally spaced apart plates 100,102 are affixed to the back face of bight 104 centrally thereof to confine the hydraulic cylinder and to provide a mounting location for the cylinder mounting pin 86.

The dozer blade 24 is mounted on the base 20 by coupling means located on the front side of the base 20 and denoted broadly by the numeral 109 in FIGS. 4, 5, 6 and 8. In this regard it will be seen that the top flange 106 has a pair of mounting holes 110 and 112 adjacent the center of flange 106, while the lower flange 108 includes a pair of corresponding holes (not shown) positioned respectively therebeneath. Holes 110 and 112 receive, respectively, upright spindles 122 and 124, which serve to pivotally mount a pair of arms 126 and 128 of the mounting means 109 to the base 20. Suitable bearings 130 associated with the spindles 122,124 facilitate the horizontal swinging movement of the arms 126 and 128.

Swinging of the arms 126 and 128 when the clam 22 has first been raised is controlled and effected by power mechanism in the nature of a pair of double-acting hydraulic cylinders 142 and 150 which lie horizontally along the front face of the base 20. Each of the arms 126 and 128 is provided with a pair of mounts 132 and 134 which receive a normally vertically oriented pivot pin 136 therethrough that is spaced a short distance from the corresponding spindle 122 or 124. Pin 136 extends through the head 138 of the shaft 140 of the corresponding cylinder 142 or 150 such that the cylinders 142 and 150 are connected to their respective arms 126 and 128 with relatively short moment arms.

Each of the cylinders 142,150 is pivotally attached at its anchor end to the front face of the bight 104 by its own pair of vertically spaced mounting ears 114 and vertical pivot pin 120, located generally adjacent opposite ends of the base 20. The cylinders 142,150 are operable to swing the arms 126 and 128 between a folded-in position as illustrated by the arm 126 in FIGS. 5 and 8, and folded-out position as illustrated by the arm 128 in the same figures. Arms 126 and 128 are generally channel-shaped to present upper and lower flat edges 152 and 154 which are interconnected by a slightly concave main body portion 156 as shown in FIGS. 6 and 8. Such configuration provides structural strength as well as clearance for the transverse cylinders 142,150 when the arms 126,128 are folded in.

Figure 5:
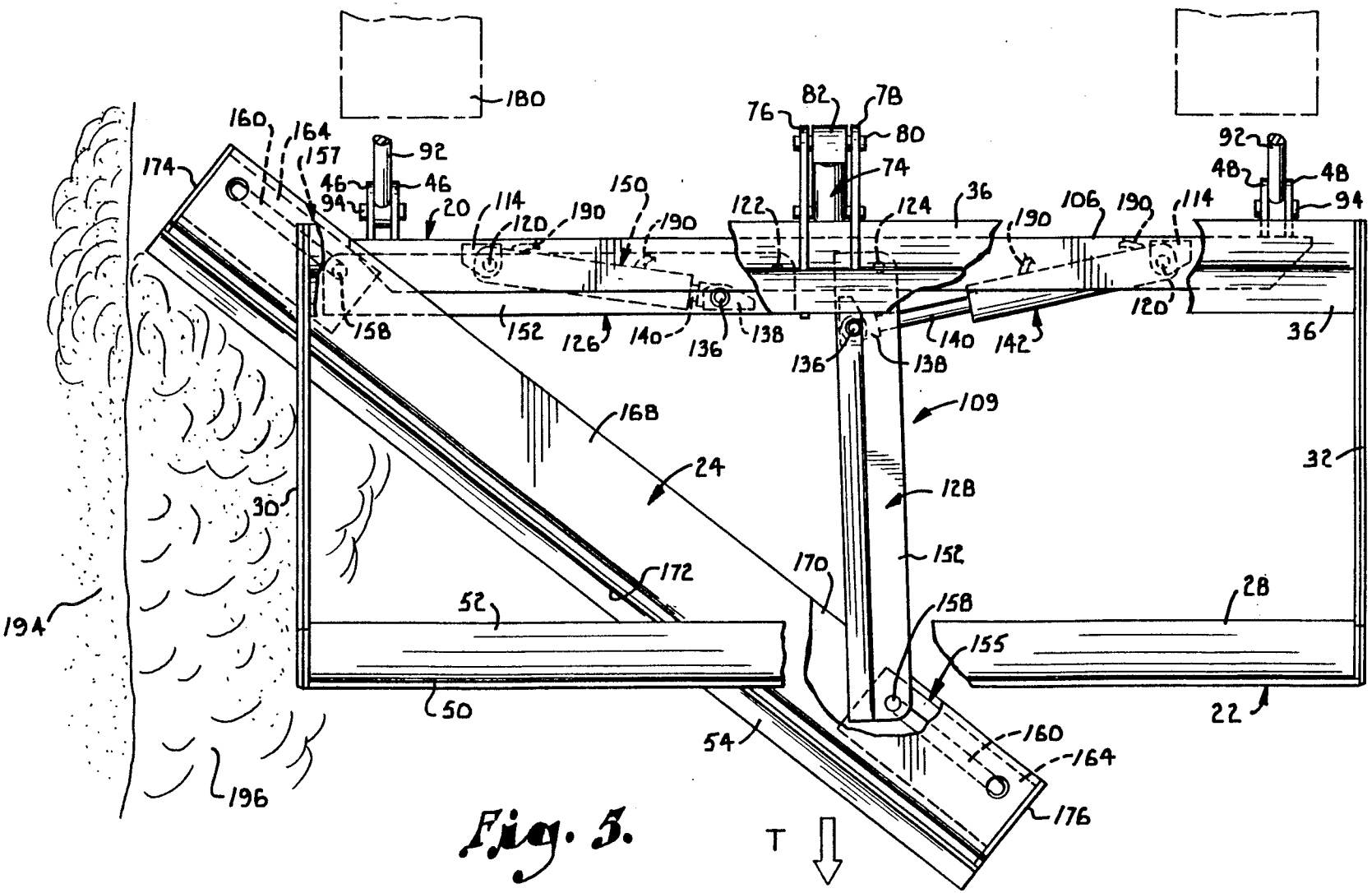
FIG. 5 is an enlarged, fragmentary top plan view of the attachment in the side-shifted angle dozer configuration with the clam raised and the dozer blade in an angled and side-shifted position to the right with respect to the direction of travel, parts being broken away to reveal details of construction.

The outer ends of the arms 126,128 are coupled with opposite ends of the dozer blade 24 through a pair of lost-motion connections 155 and 157 respectively, as shown in FIGS. 5 and 8. The lost-motion connections 155,157 provide for side-shifting of the blade 24 in addition to its angle adjustment. As shown best in FIG. 8 (and also in FIG. 6), each of the lost motion connections 155,157 includes an upright guide rod 158 adjacent the outer end of the respective arm 126,128 which spans the opposite edges 152,154 and projects a short distance beyond each of edges 152,154. The opposite extended ends of each rod 158 are received within corresponding upper and lower guide slots 160 and 162 in a pair of vertically spaced, horizontal guide plates 164 and 166 on the back side of the dozer blade 24. The distance along the blade 24 between the outer ends of the slots 160 is substantially the same as the distance between the rods 158 when arms 126,128 are fully folded in. Thus, the blade 24 must also be retracted into a centered, squared-up position when the arms 126,128 are folded in. On the other hand, the distance between the inner ends of the slots 160 along the blade 24 is substantially the same as the distance between the rods 158 when one of the arms 126 or 128 is swung out and the other remains folded-in (as in FIGS. 5 and 8). Consequently, the blade 24 must also be held in either a right or left side-shifted, angled attitude at that time, depending upon which arm is folded in and which is swung out.

The dozer blade 24 itself is of generally box-like construction (FIGS. 4, 6 and 8) with a closed top 168, closed bottom 170, closed front 172, closed ends 174,176, but an open back. The front 172 is slightly concave, and the open nature of the back permits the base 20, arms 126,128 and the transverse cylinders 142,150 all to be nested neatly within the hollow blade 24 when the attachment 10 is in its bucket configuration as in FIGS. 4 and 6 for example. It will also be noted as shown in FIG. 4 that when the attachment 10 is in its bucket configuration, the stiffening side plates 66,68 of the clam 22 partially rearwardly overlap the opposite ends 174,176 of the dozer blade 24 to rigidify the bucket and preclude lateral displacement of the blade. Thus, the blade 24 is trapped front-to-rear at this time by the upturned flange 52 of clam 22 and the base 20, and side-to-side by the stiffening side plates 66 and 68.

One exemplary loader useful in connection with the present invention is a Bobcat 2400 Loader available from the Melroe Company of Fargo, North Dakota. As shown in FIGS. 1 and 2, in addition to the loader arms 16,18, the front end loader includes lift cylinders 184 for raising loader arms 16,18, and also tilt cylinders 186 mounted to the loader arms 16,18 and connected to links 92. Links 92 and tilt cylinders 186 are additionally connected to loader arms 16,18 by bail 188, as seen in FIG. 2. The front end loader 12 naturally includes a hydraulic pump (not shown) which is connected to the various hydraulic cylinders (all of which are double-acting) by conduits 190. Controls (not shown) are provided in the cab 192 of tractor 14 so the operator can not only operate the attachment 10 in the usual way from the tractor seat, but can also convert quickly between bucket and dozer configurations.

OPERATION

In use, the convertible bucket attachment 10 is mounted on the loader arms 16,18 in the manner illustrated in FIGS. 1 and 2 in lieu of conventional buckets or dozer blade assemblies. In the bucket configuration, the material which is resting on the ground or other supporting surface may be loaded into the bucket attachment 10 in the usual way by driving the vehicle forward and passing the scraping edge 50 of the bucket 10 under the material to be lifted. Lift cylinders 184 are then extended to raise the loader arms 16,18 and thereby raise the bucket 10 off the ground.

As with conventional buckets, the convertible bucket attachment 10 hereof may be tilted to drop the material collected therein at the desired location by extending tilt cylinder 186 to pivot bale 188. In so doing, the entire attachment 10 tilts, including base 20, clam 22 and dozer blade 24.

It is to be understood that by virtue of the present configuration, the load placed on floor 28 and also against scraping edge 50 will tend to swing the clam 22 in a clockwise direction viewing FIGS. 1 and 6 so that the flange 52 is forced rearwardly against knife 54 to hold the dozer blade 24 back against the base 20. The side walls 30 and 32 of clam 22 overlap opposite lateral ends of the dozer blade 24 whereby to confine the blade 24 and render it completely immobilized at this time. The result is a very rugged, sturdy bucket that can readily withstand the rigors of heavy-duty earth-working and material handling operations, even when the front edge of the bucket 10 is used to pry loose heavy stones and other objects. It will be noted in this respect that because the clam 22 is attached directly to the base 20 via the brackets 46,48 instead of to the dozer blade 24, there is no twisting moment applied to the dozer blade 24 when the front edge of the clam is subjected to a heavy load in this manner. Instead, the clam 22 simply tends to clamp the dozer blade 24 even more tightly against the base 20.

In order to prepare the dozer blade 24 for dozing operations, the clam 22 must first be swung into a raised position as illustrated in FIG. 3 to expose the dozer blade 24. This is accomplished by actuating double-acting hydraulic cylinder 74 to retract shaft 84 and thus bring head 82 down toward cylinder 74. Once the clam 22 is raised, the dozer blade 24 may be left in its centered, straight-forward position if desired and used to push materials straight ahead when the tractor is advanced.

On the other hand, once the clam 22 has been raised, the dozer blade 24 is also released for either right or left side-shifting and angle displacement if such is desired for the particular job at hand. In the illustration of FIGS. 5 and 8, for example, the dozer blade 24 has been shifted and angled to the right (as viewed from the rear of the machine), although it is to be understood that the blade 24 could just as easily have been shifted and angle-adjusted to the left.

Using the right angle shifted position of FIGS. 5 and 8 as an example, it will be understood that movement of the dozer blade 24 to that position is effected by operating the appropriate control in the tractor cab 192 to extend the swing cylinder 142 while keeping the other swing cylinder 150 fully retracted. Although not illustrated in the drawings, it is to be understood that the guide rods 158 of the lost motion connections 155,157 are at the outer ends of their guide slots 160 in the dozer blade 24 when the blade 24 is in its centered, straightforward position of FIGS. 3, 4 and 6. Thus, when the cylinder 142 is initially extended and the swing arm 128 starts to swing outwadly away from its folded-in, transverse position toward its folded-out, longitudinal position of FIGS. 5 and 8, the guide rod 158 of lost motion connection 155 slides toward the inner end of the slot 160 until it can go no further. Further outward swinging of the swing arm 128 thus has the effect not only of pushing the left end of the dozer blade 24 outwardly, but also of displacing the blade 24 in a rightward direction along its own longitudinal axis until the rod 158 of the other lost motion connection 157 bottoms out at the inner end of its slot 160. Consequently, as shown most clearly in FIG. 5, even though the blade 24 started out fully within the lateral boundries defined by the opposite side walls 30 and 32 of the clam 22, in its final side-shifted and angle adjusted position the blade 24 has its right end projected laterally outwardly beyond the corresponding right side wall 30 of the clam 22. Once the cylinder 142 is fully extended, the operator may simply release the control valve or otherwise move it to a position which hydraulically locks the cylinder 142 in its extended state while the cylinder 150 is also locked in its retracted state, thus rigidly and securely holding the blade 24 in its side-shifted, angled position.

With the dozer blade 24 in this position, the vehicle is ideally suited for windrowing loose materials which are scattered on the ground, or for backfilling a ditch such as the ditch 194 illustrated in FIG. 5. By advancing alongside of the ditch 194 in the direction of forward travel "T" illustrated in FIG. 5 with the rightwardly projected end of the dozer blade 24 engaging the "spoil" pile 196 of loose soil which has been previously removed from the ditch, the dozer blade 24 simply diverts and rolls the spoil 196 smoothly and continuously into the ditch as the vehicle continues to advance. Because of the laterally projected condition of the dozer blade 24, the front wheel 180 of the tractor can be maintained at a safe distance from the sides of the ditch to guard against the risk of cave in. Moreover, with the right end of the dozer blade 24 shifted outboard of the right side wall 30 of the clam 22, the operator has an excellent view of the soil as it rolls into the ditch so that he may react quickly to any steering adjustments that may become necessary as the backfilling operation is carried out.

Having the dozer blade 24 side-shifted as well as angle-adjusted improves the steerability of the tractor 14 compared to that which would exist if the dozer blade 24 were only angle-adjustable and not also side-shiftable. This improvement would be particularly noticeable where light tractors were utilized and the spoil pile quite large. Without side-shift of the dozer blade 24, there would be a tendency for the reaction force from the spoil pile to swing the tractor out away from the ditch and make steering difficult; that tendency is decreased when the blade 24 is side-shifted.

When the operator wants to return to the bucket configuration, he merely needs to operate the appropriate control at the tractor seat to swing the dozer blade 24 back into its centered position and then lower the clam 22 back down into its original position against the dozer blade 24. Assuming for the sake of illustration that the dozer blade 24 is at the right shifted, angle adjusted position of FIGS. 5 and 8 prior to returning to the bucket configuration, the operator causes the swing cylinder 142 to retract and progressively swing the control arm 128 back to its folded-in position along the base 20. As the arm 128 swings in a counterclockwise direction viewing FIG. 5, the rod 158 of the lost motion connection 155 slides to the outer end of slot 160 such that further inward swinging of the arm 128 has the effect of pulling the dozer blade 24 laterally inwardly at the same time it is being swung back toward the squared up position. Such pulling action by the inwardly swinging arm 128 on the left end of the dozer blade 24 also causes the rod 158 of lost motion assembly 157 at the right end of the blade 24 to slide to the outer end of its slot 160 until rod 158 can go no further. By the time the dozer blade 24 has been fully returned to its centered, squared up position, the cylinder 142 will be fully retracted and both of the rods 158 will have been shifted to the outermost ends of their respective guide slots 160. Extension of the clam cylinder 74 then lowers the clam 22 into clamping position against the dozer blade 24 to reestablish the loading bucket configuration.

It is to be appreciated that converting the attachment of the present invention between bucket and dozer configurations can be carried out virtually instantaneously from the tractor seat without disconnecting and interchanging heavy components. Thus, the operator has full use of an excellent loading bucket for all of the many jobs which require that kind of a loading implement while having instant access to a straight dozer blade or a right or left shifted, obliquely angled dozer blade for the times backfilling or cleanup is required. Even though the dozer blade may only be needed for relatively brief intervals throughout the day, the operator can quickly and easily shift back and forth between bucket and dozing modes at will to provide safe, efficient and high quality work in the least amount of time. By using the clam 22 in swingable cooperation with the front face of the dozer blade 24, the operator can also use the attachment for picking up and transporting bulky objects such as logs and large stones.

Although preferred forms of the invention have been described above, it is to be recognized that such disclosure is by way of illustration only, and should not be utilized in a limiting sense in interpreting the scope of the present invention. Obvious modifications to the exemplary embodiments, as hereinabove set forth, could be readily made by those skilled in the art without departing from the spirit of the present invention.

The inventor hereby states his intent to rely on the Doctrine of Equivalents to determine and assess the reasonably fair scope of his invention as pertains to any apparatus not materially departing from but outside the literal scope of the invention as set out in the following claims.

I claim:

1. In a loader attachment, the improvement comprising:

a dozer blade;

a clam having a pair of opposite, upright side walls and a floor extending between said side walls;

means mounting said clam for movement between a lowered position in which the clam cooperates with the dozer blade to present a loading bucket wherein the dozer blade forms the back wall of the bucket and the clam forms the opposite sides and floor of the bucket, and a raised position in which the clam exposes the dozer blade for dozing operations; and means mounting said dozer blade for shifting said dozer blade independently of said claim when the clam is in its raised position, wherein said shifting is between a centered, straight-forward position and right or left, laterally shifted, obliquely angled positions in which the dozer blade is both displaced laterally from the centered position and is disposed at an angle with respect to the normal path of travel of the attachment during use.

2. In a loader attachment as claimed in claim said clam and said dozer blade being supported by a common base, said mounting means for the clam including a first coupling between the clam and the base and power means for raising and lowering the clam relative to the base, said mounting means for the dozer blade including a second coupling between the dozer blade and the base and power mechanism for shifting the dozer blade laterally and angling it obliquely relative to the base.

3. In a loader attachment as claimed in claim 2, said first coupling comprising a transverse, horizontal pivot between the clam and the base.

4. In a loader attachment as claimed in claim 2, said second coupling comprising a pair of arms each pivotally connected at an inner end to the base for horizontal swinging movement between folded-in positions extending transverse to the normal path of travel of the attachment and folded-out positions extending generally longitudinally of the path of travel of the attachment, said second coupling means further comprising lost motion connections between outer ends of the arms and the dozer blade, each of which lost motion connections includes a vertical pivot which is shiftable along the dozer blade through a limited amount of lost travel during shifting of the dozer blade, said power mechanism including a separate power device for each of said arms respectively operable to maintain both of the arms folded in when the dozer blade is in its centered, straight-forward position, one of the arms folded in and the other arm folded out when the dozer blade is in its left laterally shifted, obliquely angled position, and said one arm folded out and said other arm folded in when the dozer blade is in its right laterally shifted, obliquely angled position.

5. In a loader attachment as claimed in claim 2, said clam being disposed to clamp the dozer blade against the base when the clam is in its lowered position, cooperating with the dozer blade to present a loading bucket.

6. In a loader attachment as claimed in claim 5, said side walls of the clam having confinement structure thereon disposed to overlap opposite lateral ends of the dozer blade when the clam cooperates with the dozer blade to present a loading bucket, whereby to confine the dozer blade against lateral shifting.

7. In a loader attachment as claimed in claim 2, said side walls of the clam having confinement structure thereon disposed to overlap opposite lateral ends of the dozer blade when the clam cooperates with the dozer blade to present a loading bucket, whereby to confine the dozer blade against lateral shifting.

8. In a multi-purpose, material handling vehicle that includes a mobile chassis, the improvement comprising:

a pair of laterally spaced, powered lift arms swingably mounted on the chassis for up and down lifting and lowering movement;

a rigid base extending transversely between and mounted on said lift arms for movement with the lift arms during their lifting and lowering motions;

a dozer blade carried in front of said base;

a clam having a pair of opposite, upright side walls and a floor extending between said side walls;

means swingably mounting said clam on the base for movement between a lowered position in which the clam cooperates with the dozer blade to present a loading bucket wherein the dozer blade forms the back wall of the bucket and the clam forms the opposite sides and floor of the bucket, and a raised position in which the clam exposes the dozer blade for dozing operations; and means shiftably mounting said dozer blade on the base for shifting said dozer blade independently of said clam when the clam is in its raised position, wherein said shifting is between a centered, straight-forward position and a right or left, laterally shifted, obliquely angled position in which the dozer blade is both displaced laterally from the centered position and is disposed at an oblique angle to the normal path of travel of the vehicle.

9. In a multi-purpose vehicle as claimed in claim 8, said mounting means for the clam including a first coupling between the clam and the base and double-acting, fluid-pressure power means for swinging the clam between its raised and lowered positions about said first coupling, said mounting means for the dozer blade including a second coupling between the dozer blade and the base and double-acting, fluid-pressure power mechanism for shifting the dozer blade laterally and angling it obliquely relative to the base.

10. In a multi-purpose vehicle as claimed in claim 9, said first coupling comprising a transverse, horizontal pivot between the clam and the base.

11. In a multi-purpose vehicle as claimed in claim 9, said second coupling comprising a pair of arms each pivotally connected at an inner end to the base for horizontal swinging movement between folded-in positions extending transverse to the normal path of travel of the attachment and folded-out positions extending generally longitudinally of the path of travel of the attachment, said second coupling means further comprising lost motion connections between outer ends of the arms and the dozer blade, each of which lost motion connections includes a vertical pivot which is shiftable along the dozer blade through a limited amount of lost travel during shifting of the dozer blade, said power mechanism including a separate power device for each of said arms respectively operable to maintain both of the arms folded in when the dozer blade is in its centered, straight-forward position, one of the arms folded in and the other arm folded out when the dozer blade is in its left laterally shifted, obliquely angled position, and said one arm folded out and said other arm folded in when the dozer blade is in its right laterally shifted, obliquely angled position.

12. In a multi-purpose vehicle as claimed in claim 8, said clam being disposed to clamp the dozer blade against the base when the clam is in its lowered position, cooperating with the dozer blade to present a loading bucket.

13. In a multi-purpose vehicle as claimed in claim 12, said side walls of the clam having confinement structure thereon disposed to overlap opposite lateral ends of the dozer blade when the clam cooperates with the dozer blade to present a loading bucket, whereby to confine the dozer blade against lateral shifting.

14. In a multi-purpose vehicle as claimed in claim 8, said side walls of the clam having confinement structure thereon disposed to overlap opposite lateral ends of the dozer blade when the clam cooperates with the dozer blade to present a loading bucket, whereby to confine the dozer blade against lateral shifting.

15. In an attachment adapted for mounting on the two lift arms of a front end loader, the improvement comprising:

a transverse, rigid base having a front and a back with respect to the normal path of travel of the attachment during use, said base being provided with a pair of mounting brackets on the back thereof useable in attaching the base to the lift arms of the loader;

a clam having a pair of opposite, upright side walls and a floor extending between said side walls;

pivotal mounting means projecting upwardly from said base and coupled with the clam at a location spaced above the base to permit up and down swinging movement of the clam across the front of the base about a transverse axis between raised and lowered positions;

double-acting hydraulic power means on the back of the base connected between the base and the clam for causing powered swinging movement of the clam between its raised and lowered positions;

a pair of swing arms on the front of the base with respect to the normal direction of travel of the attachment, each of said swing arms being pivotally connected at an inner end thereof to the base for horizontal swinging movement between folded-in positions in which the arms extend transverse to the normal path of travel of the attachment and folded-out positions in which the arms extend generally longitudinally of the path of travel of the attachment;

separate, independently operable, double-acting fluid-power devices on the front of the base operably coupled between the base and a corresponding swing arm for causing powered swinging movement of the swing arms independently of one another between said folded-in and folded-out positions;

a dozer blade carried by said swing arms at outer ends of the latter; and a pair of lost motion connections between outer ends of the arms and the dozer blade generally adjacent opposite lateral ends of the dozer blade, said clam when in its lowered position cooperating with the dozer blade to present a loading bucket wherein the dozer blade forms the back wall of the bucket and the clam forms the opposite sides and floor of the bucket, said clam when in its raised position being disposed to expose the dozer blade for dozing operations and for side-shift angle adjustment, said separate power devices being operable through said swing arms when the clam is in its raised position to shift the dozer blade between a centered, straight-forward position and a right or left, laterally shifted, obliquely angled position in which the dozer blade is both displaced laterally from the centered position and is disposed at an oblique angle with respect to the normal path of travel of the attachment, said separate power devices being operable to maintain both of the arms folded in when the dozer blade is in its centered, straight-forward position, one of the arms folded in and the other arm folded out when the dozer blade is in its left laterally shifted, obliquely angled position, and said one arm folded out and said other arm folded in when the dozer blade is in its right laterally shifted, obliquely angled position, each of said lost motion connections including a vertical pivot which is shiftable along the dozer blade through a limited amount of lost motion travel during said side-shift angle adjustment of the dozer blade.

16. A convertible bucket and side-shift angle dozer attachment for front end loaders comprising:

a clam presenting a floor extending between and connected to a pair of opposed, spaced-apart substantially vertically extending side walls;

a dozer blade presenting first and second spaced-apart ends, said dozer blade being sized for positioning said spaced-apart ends between said side walls of said clam;

a main frame operatively connected to said clam and said dozer blade including means for shifting said clam in a vertical plane between a first position wherein said dozer blade is located between said side walls and adjacent said floor of said clam and a second position wherein said clam is located in vertically spaced relationship above said dozer blade; and means connected to said main frame for shifting said dozer blade independently of said clam between a first position wherein said dozer blade is substantially normal to its intended direction of movement and positioned laterally within vertical planes defined by said sidewalls and a second position wherein said dozer blade is obliquely angled relative to its intended direction of movement and at least a part of said dozer blade is shifted laterally outboard of one of said vertical planes when said clam is located in said vertically spaced relationship above said dozer blade.

17. A convertible bucket and side-shift angle dozer as set forth in claim 16, said sides of said clam being substantially parallel.

18. A convertible bucket and side-shift angle dozer as set forth in claim 16, said dozer blade being co-operatively configured with said clam for positioning with said clam to define a back wall thereof.

19. A convertible bucket and side-shift angle dozer as set forth in claim 16, wherein said means for vertically shifting said clam includes structure pivotally mounting said clam to said main frame.

20. A convertible bucket and side-shift angle dozer as set forth in claim 19, wherein said means for vertically shifting said clam includes a hydraulic cylinder presenting an extensible arm operatively connecting said main frame and said clam for pivoting the clam relative to the main frame.

21. A convertible bucket and side-shift angle dozer as set forth in claim 16, wherein said shifting means includes means for angling said dozer blade to position the first end forwardly of the second end with respect to the direction of travel, and alternatively to angle said dozer blade to position the second end forwardly of the first end with respect to the intended direction of travel.

22. A convertible bucket and side-shift angle dozer as set forth in claim 21, said angling means including first and second arms having one end pivotally connected to said main frame with an opposed end pivotally connected to said dozer blade at predetermined mounting slots on said dozer blade adjacent the respective ends thereof for permitting limited lateral shifting of said dozer blade relative to said arms, and drive means pivotally connected to each of said first and second arms and said main frame, said drive means being extensible toward said dozer blade to angle said dozer blade relative to said main frame and simultaneously shift said dozer blade laterally.

* * * * *